US008061173B2

(12) United States Patent
Hawkes

(10) Patent No.: US 8,061,173 B2
(45) Date of Patent: Nov. 22, 2011

(54) CONTINUOUS EXTRUSION APPARATUS

(75) Inventor: Daniel John Hawkes, Shadoxhurst (GB)

(73) Assignee: BWE Limited, Kent, England (GB)

( * ) Notice: Subject to any disclaimer, the term of this patent is extended or adjusted under 35 U.S.C. 154(b) by 36 days.

(21) Appl. No.: 12/662,507

(22) Filed: Apr. 21, 2010

(65) Prior Publication Data

US 2011/0162428 A1 Jul. 7, 2011

Related U.S. Application Data

(63) Continuation of application No. PCT/GB2008/003830, filed on Nov. 14, 2008.

(30) Foreign Application Priority Data

Nov. 15, 2007 (GB) ..... 0722515.4

(51) Int. Cl.
*B21C 23/00* (2006.01)

(52) U.S. Cl. ..... 72/262; 72/269

(58) Field of Classification Search ..... 72/262, 72/264, 269, 425
See application file for complete search history.

(56) References Cited

U.S. PATENT DOCUMENTS

| | | | | |
|---|---|---|---|---|
| 2,105,083 | A | 1/1938 | Kagi et al. | |
| 2,869,220 | A | 1/1959 | Raydt et al. | |
| 3,572,074 | A | 3/1971 | Holdup et al. | |
| 3,732,717 | A | 5/1973 | Ahlvers | |
| 3,834,209 | A * | 9/1974 | Robertson | 72/269 |
| 3,985,011 | A * | 10/1976 | Fuchs, Jr. | 72/60 |
| 4,564,347 | A | 1/1986 | Vaughan | |
| 5,147,085 | A | 9/1992 | Hawkes et al. | |
| 5,152,163 | A | 10/1992 | Hawkes et al. | |
| 5,197,319 | A | 3/1993 | Beekel et al. | |
| 5,813,270 | A * | 9/1998 | Carter | 72/262 |
| 5,829,298 | A | 11/1998 | Linsenbardt et al. | |
| 5,836,191 | A | 11/1998 | Wright | |
| 5,887,473 | A | 3/1999 | Hawkes | |

(Continued)

FOREIGN PATENT DOCUMENTS

| | | | |
|---|---|---|---|
| EP | 0 071 490 | | 8/1982 |
| EP | 0 202 953 | A2 | 11/1986 |
| EP | 0 398 747 | A1 | 11/1990 |
| WO | WO 2006/043069 | A | 4/2006 |

OTHER PUBLICATIONS

U.S. Appl. No. 12/543,136, filed Mar. 2010, Hawkes.

(Continued)

*Primary Examiner* — Dana Ross
*Assistant Examiner* — Homer Boyer
(74) *Attorney, Agent, or Firm* — Shlesinger, Arkwright & Garvey LLP

(57) ABSTRACT

Extrusion mandrel assembly for continuous extrusion apparatus has a lobed, mushroom shaped, dolly formed with a central spacing stem located in the chamber adjacent a pair of discharge ports connecting respective exit apertures into an internal cavity in the chamber and a pair of shaped lobes having rear faces extending from central spacing stem, outer edge portions and front faces merging into a collar around a neck co-acting with an annular shoulder on extrusion die body to form an annular extrusion gap, with each lobe profiled so frictional surface drag on extruding material is uniform around lobed dolly. Individual paths between discharge ports and annular extrusion gap are equal in length as measured on respective surfaces of the rear faces, edge portions and front faces of profiled lobes. An extruded aluminium cylindrical tube up to 150 mm diameter and wall thickness of 1 mm to 4 mm may be formed avoiding discontinuities.

2 Claims, 3 Drawing Sheets

U.S. PATENT DOCUMENTS

| | | | |
|---|---|---|---|
| 6,619,093 | B2 | 9/2003 | Dawson et al. |
| 6,655,415 | B2 | 12/2003 | Dawson et al. |
| 6,988,389 | B2 | 1/2006 | Hawkes |
| 7,194,885 | B2 | 3/2007 | Hawkes |
| 2005/0268682 | A1 | 12/2005 | Hawkes |
| 2006/0156782 | A1 | 7/2006 | Hawkes |
| 2008/0118595 | A1 | 5/2008 | Hawkes |

OTHER PUBLICATIONS

Written Opinion of the International Searching Authority of PCT/GB2008/003830 dated Feb. 26, 2009, 5 pgs.

International Search Report of PCT/GB2008/003830 dated Feb. 26, 2009, 4 pgs.

* cited by examiner

CONTINUOUS EXTRUSION APPARATUS

CROSS-REFERENCE TO RELATED APPLICATIONS

This application is a continuation of application no. PCT/GB2008/003830, filed Nov. 14, 2008, which claims the priority of United Kingdom application no. 0722515.4, filed Nov. 15, 2007, and each of which is incorporated herein by reference.

FIELD OF THE INVENTION

This invention relates to apparatus for the forming of metals by a continuous extrusion process in which feed stock is introduced into a circumferential groove in a rotating wheel to pass into a passageway formed between the groove and arcuate tooling extending into the groove. The tooling includes an exit aperture formed in a shoe portion and extending in a generally radial direction from the groove to a die and an abutment is provided to constrain the feedstock to flow through the exit aperture and the die.

BACKGROUND OF THE INVENTION

In WO 90/14176 there is described continuous extrusion apparatus having a plurality of spaced apart circumferential grooves, arcuate tooling with a shoe portion bounding radially outer portions of the respective grooves provided with exit apertures extending in a generally radial direction from the respective grooves to a chamber and abutments displaced in the direction of rotation from the exit apertures extending into the grooves, the chamber extending around an extrusion mandrel assembly and the exit apertures discharging axially of the extrusion mandrel assembly through a die orifice intermediate the extrusion mandrel assembly and an extrusion die body wall.

OBJECTS AND SUMMARY OF THE INVENTION

It is an object of the invention to overcome the drawbacks of the prior art.

According to the present invention, the extrusion mandrel assembly includes a lobed, mushroom shaped, dolly formed with a central spacing stem located in the chamber adjacent a pair of discharge ports connecting respective exit apertures into an internal cavity in the chamber and a pair of shaped lobes having rear faces extending from the central spacing stem, outer edge portions and front faces merging into a collar around a neck co-acting with an annular shoulder on the extrusion die body to form an annular extrusion gap, with each of the lobes being profiled such that frictional surface drag on extruding material—is substantially uniform around the lobed dolly.

Preferably each of the lobes is profiled such that individual paths between the discharge ports and the annular extrusion gap are substantially equal in length as measured on the respective surfaces of the rear faces, edge portions and front faces of the profiled lobes.

BRIEF DESCRIPTION OF THE DRAWING

The invention will now be described, by way of example, with reference to the accompanying, perspective and partly diagrammatic drawings, in which.

DETAILED DESCRIPTION OF THE INVENTION

Figure 1:
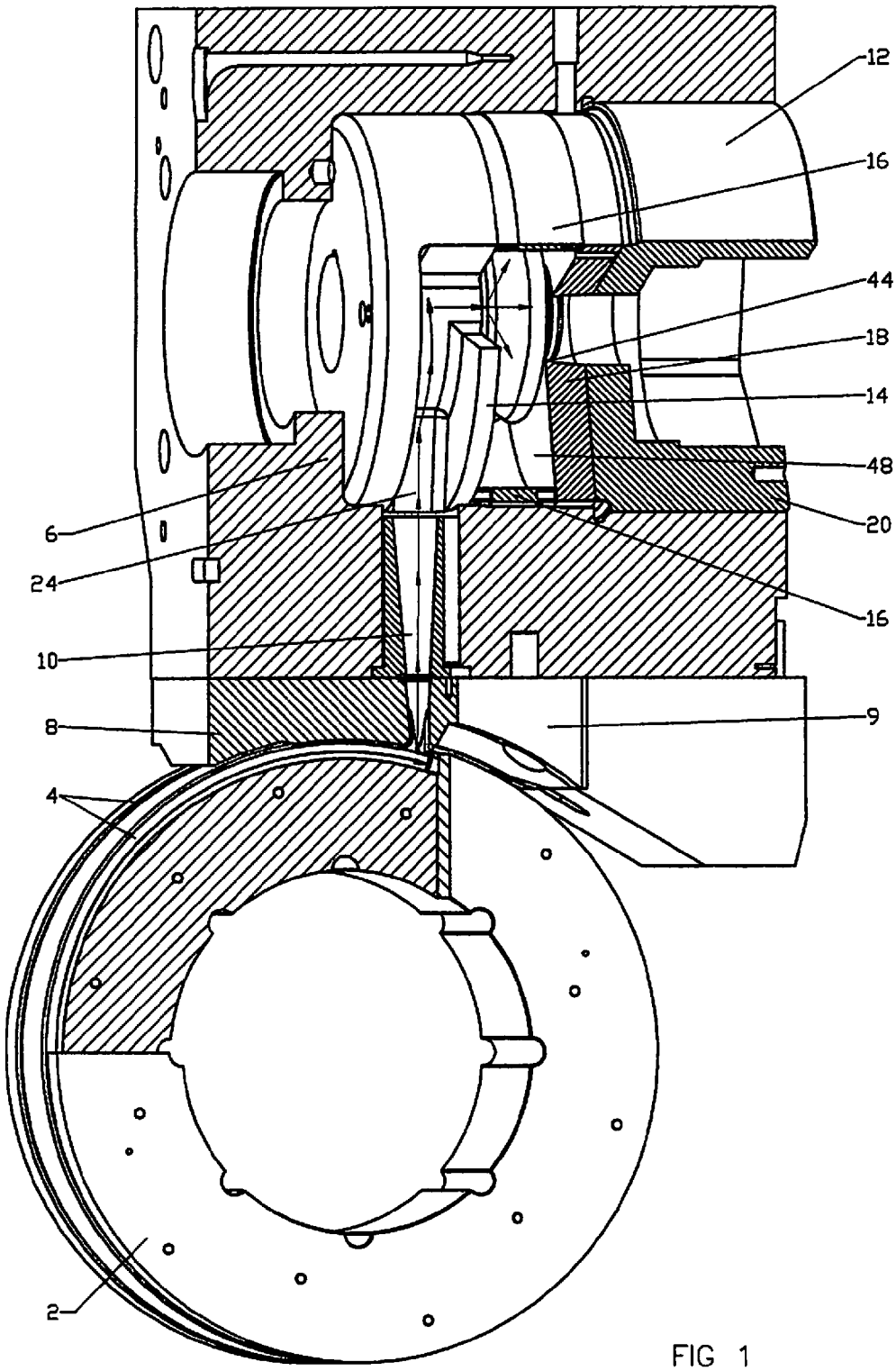
FIG. 1 is a partly sectioned view of a portion of a continuous extrusion apparatus with various parts omitted.
Figure 2:
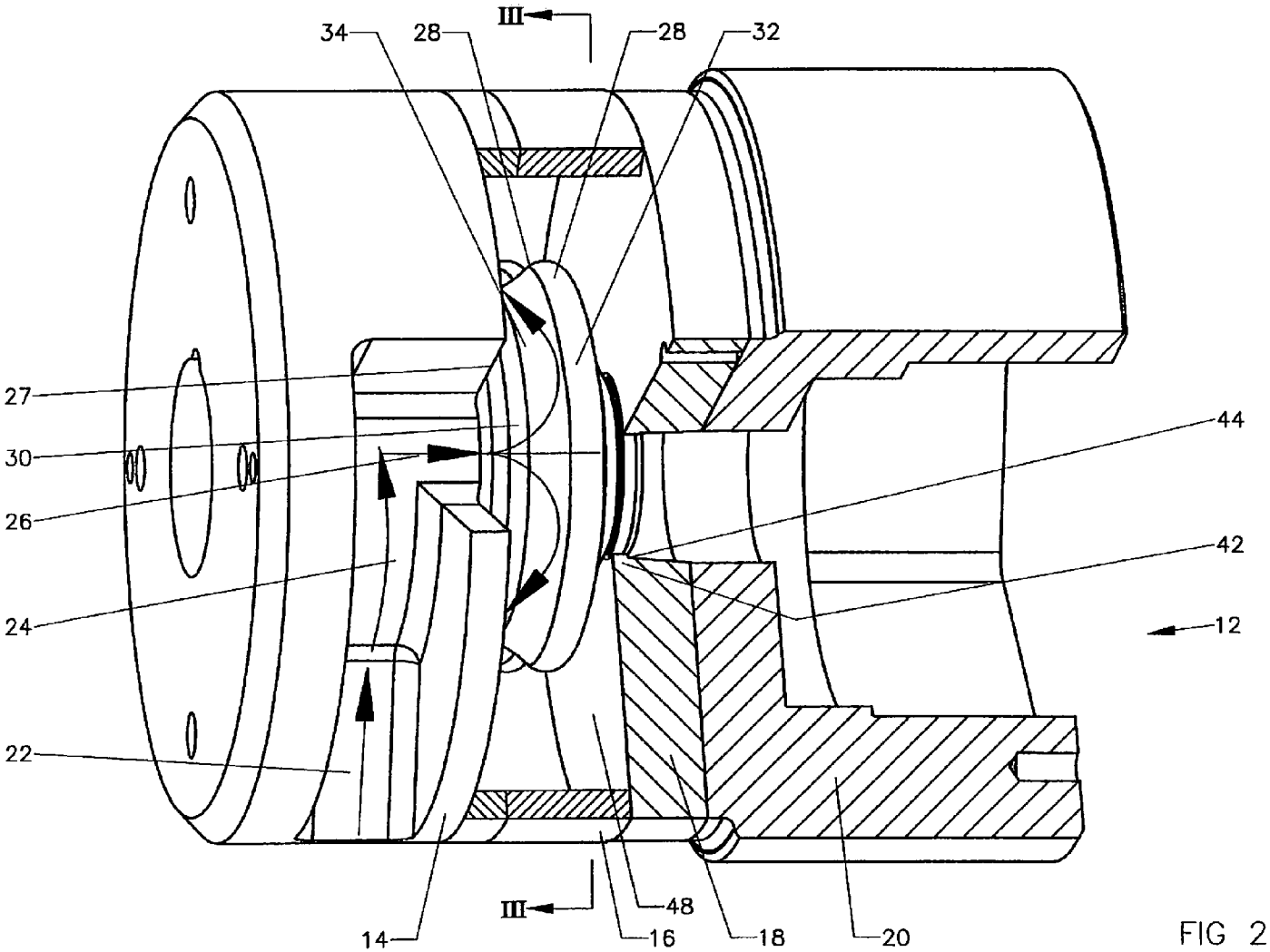
FIG. 2 is a portion of FIG. 1 an enlarged scale.
Figure 3:
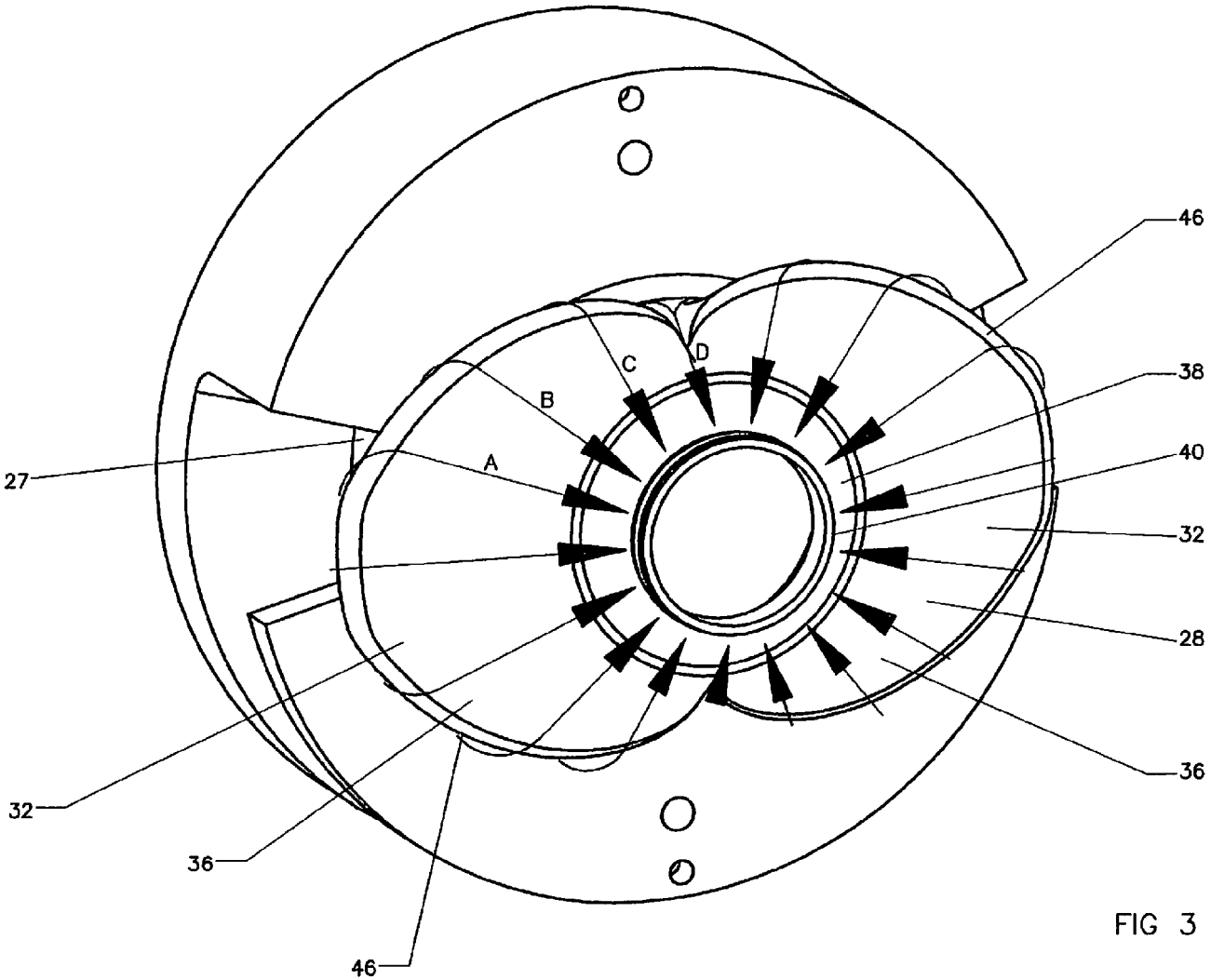
FIG. 3 is a view of a portion of FIG. 2 taken in the direction indicated by the arrows III-III.

Referring to the drawings, there is shown a wheel portion 2 of a continuous extrusion apparatus formed with a pair of axially spaced circumferential grooves 4. A die chamber 6 is positioned on the shoe portion 8 of the apparatus with abutments 9 extending into the grooves 4 and is formed with a pair of divergent, frusto-conical exit apertures 10 in register with the grooves 4. Positioned in the die chamber 6 is an extrusion mandrel assembly 12, a mixer plate 14, a spacer ring 16, an extrusion die 18 and a die support 20.

The mixer plate 14 includes a pair of rectangular cross-section passages 22 (one only of which is shown), disposed to either side of a, vertical plane extending diametrically of the wheel 2 central of the pair of grooves 4, registering with respective exit apertures 10, each of which respectively discharges to an arcuate, rectangular cross-section, passage 24 and thence to an axial passage 26 having an arcuate cross-section discharge port 27 positioned on a vertical plane perpendicular to the longitudinal axis of the mixer plate. The mixer plate 14 includes a lobed, mushroom shaped, dolly 28 having a cylindrical spacing stem 30 and a pair of shaped lobes 32 with frusto-conical rear faces 34 and planar front faces 36 merging into a frusto-conical collar 38 around a neck 40. The neck 40 co-acts with an annular shoulder 42 on the extrusion die 18 to form an annular extrusion gap 44. Each of lobes 32 is profiled such that individual paths A, B, C, D etc between the arcuate discharge ports 27, across the rear faces 34, over respective edges 46 and across the front faces 36 to the frusto-conical collar 38 and the neck 40 are of substantially equal length as measured on the respective surfaces.

In operation, to extrude a thin walled (say between 1 mm and 4 mm), large diameter (say up to 150 mm) aluminium tube, the continuous extrusion apparatus is operated to produce respective flows of material from the grooves 4 into the divergent apertures 10 to discharge through the pair of arcuate discharge ports 27 into a cavity 48 with respective flows merging to flow around the lobed dolly 28 and extrude through the annular extrusion gap 44 as a cylindrical extrusion.

Since the individual distances from the respective arcuate discharge ports 27 over the rear faces 34, the edges 46, the front faces 36, the frusto-conical collar 38 and the neck 40, as measured on their respective surfaces, are substantially equal, the frictional surface drag on the extruding material is substantially uniform around the lobed dolly 28, the shear forces in the extruding material across the direction of flow are reduced to a minimum and the flow from the respective discharge ports 27 merge evenly together so that the extruding material is delivered to the annular extrusion gap 44 uniformly, such that a cylindrical tube of uniform, or substantially uniform, wall thickness is extruded from the annular extrusion gap 44.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Continuous extrusion apparatus, comprising:

a) a plurality of spaced apart circumferential grooves;

b) arcuate tooling with a shoe portion bounding radially outer portions of respective grooves provided with exit apertures extending in a generally radial direction from the respective grooves to a chamber;

c) abutments displaced in the direction of rotation from the exit apertures extending into the grooves;

d) the chamber extending around an extrusion mandrel assembly, and the exit apertures discharging axially of the extrusion mandrel assembly through a die orifice intermediate the extrusion mandrel assembly and an extrusion die body wall;

e) the extrusion mandrel assembly including:

i) a lobed, mushroom shaped, dolly formed with a central spacing stem located in the chamber adjacent a pair of discharge ports connecting respective exit apertures into an internal cavity in the chamber;

ii) a pair of shaped lobes having rear faces extending from the central spacing stem;

iii) outer edge portions and front faces merging into a collar around a neck co-acting with an annular shoulder on the extrusion die body to form an annular extrusion gap; and iv) each of the lobes being profiled such that frictional surface drag on extruding material is substantially uniform around the lobed dolly.

2. Continuous extrusion apparatus as claimed in claim 1, wherein:

a) each of the lobes is profiled such that individual paths between the discharge ports and the annular extrusion gap are substantially equal in length as measured on the respective surfaces of the rear faces, edge portions, and front faces of the profiled lobes.

* * * * *